US008953976B2

(12) United States Patent
Ohyama et al.

(10) Patent No.: US 8,953,976 B2
(45) Date of Patent: Feb. 10, 2015

(54) DEVELOPING DEVICE, IMAGE FORMING APPARATUS, AND PROCESS CARTRIDGE

(75) Inventors: Kunihiro Ohyama, Tokyo (JP); Masayuki Yamane, Kanagawa (JP); Takeshi Uchitani, Kanagawa (JP); Yasufumi Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 68 days.

(21) Appl. No.: 13/588,115

(22) Filed: Aug. 17, 2012

(65) Prior Publication Data

US 2013/0051841 A1 Feb. 28, 2013

(30) Foreign Application Priority Data

Aug. 24, 2011 (JP) ..... 2011-182982

(51) Int. Cl.

| | |
|---|---|
| ***G03G 15/08*** | (2006.01) |
| ***G03G 15/04*** | (2006.01) |
| ***G03G 21/16*** | (2006.01) |
| ***G03G 21/18*** | (2006.01) |

(52) U.S. Cl.

CPC ..... *G03G 21/1647* (2013.01); *G03G 21/1676* (2013.01); *G03G 21/186* (2013.01)

USPC ..... 399/103; 399/119; 399/167

(58) Field of Classification Search

USPC ..... 399/103, 167, 252, 254

See application file for complete search history.

(56) References Cited

U.S. PATENT DOCUMENTS

| | | | | |
|---|---|---|---|---|
| 2002/0034403 | A1* | 3/2002 | Ueno et al. | 399/252 |
| 2006/0147225 | A1 | 7/2006 | Harada et al. | |
| 2007/0166079 | A1 | 7/2007 | Ichikawa et al. | |
| 2010/0329699 | A1 | 12/2010 | Ohyama et al. | |
| 2011/0008075 | A1 | 1/2011 | Taguchi et al. | |
| 2011/0058858 | A1 | 3/2011 | Fukuda et al. | |
| 2011/0176820 | A1 | 7/2011 | Kadota et al. | |
| 2011/0311281 | A1 | 12/2011 | Ohyama et al. | |
| 2012/0141169 | A1 | 6/2012 | Yamane et al. | |

FOREIGN PATENT DOCUMENTS

| | | |
|---|---|---|
| EP | 0 833 235 A2 | 4/1998 |
| JP | 2003-263012 | 9/2003 |
| JP | 2007-310340 | 11/2007 |

OTHER PUBLICATIONS

U.S. Appl. No. 13/355,020, filed Jan. 20, 2012, Yoshihiro Fujiwara, et al.

Combined Office Action and Search Report issued on Feb. 21, 2014, in Chinese Patent Application No. 201210298699.5 (with English translation of category of cited documents).

* cited by examiner

*Primary Examiner* — Erika J Villaluna

(74) *Attorney, Agent, or Firm* — Oblon, Spivak, McClelland, Maier & Neustadt, L.L.P.

(57) ABSTRACT

A developing device including a developer bearing member rotatable while bearing developer on a surface thereof, a rotary body having a rotary shaft, a casing that contains the developer supplied to the surface of the developer bearing member to accommodate at least a portion of the rotary body, a rotary gear having a rotary shaft parallel to the rotary shaft of the rotary body and disposed outside a lateral wall of the casing to support an end of the rotary shaft of the rotary body, and a stationary shaft member fixed to the lateral wall of the casing to rotatably support the rotary gear. An axial center of the stationary shaft member is collinear with an axial center of the rotary shaft of the rotary body.

14 Claims, 8 Drawing Sheets

DEVELOPING DEVICE, IMAGE FORMING APPARATUS, AND PROCESS CARTRIDGE

CROSS-REFERENCE TO RELATED APPLICATION

The present patent application is based on and claims priority pursuant to 35 U.S.C. §119 from Japanese Patent Application No. 2011-182982, filed on Aug. 24, 2011 in the Japan Patent Office, which is incorporated by reference herein in its entirety.

BACKGROUND OF THE INVENTION

1. Field of the Invention

Illustrative embodiments described in this patent specification generally relate to a developing device used for a copier, a printer, a facsimile machine, or the like, an image forming apparatus including the developing device, and a process cartridge removably installable in the image forming apparatus.

2. Description of the Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

A developing device that uses two-component developer including toner and magnetic carrier is widely used in the image forming apparatuses. The developing device using the two-component developer often includes a developer bearing member (e.g., a developing roller) that rotates around a rotary shaft thereof and a casing that forms a developer container from which the developer is supplied to the developing roller. A developer conveyance path such as a supply path that supplies the developer to the developing roller while conveying the developer in a direction parallel to an axial direction of the developing roller and a conveyance screw rotated to convey the developer in the developer conveyance path in the direction parallel to the axial direction of the developing roller are provided within the casing of the developing device.

The developing device further includes a drive transmission unit composed of a gear train that transmits torque supplied externally to rotary bodies such as the developing roller and the conveyance screw provided to the developing device. The drive transmission unit is disposed outside a lateral wall of the casing of the developing device provided to one end of the casing in the axial direction. The drive transmission unit includes a drive input gear to which torque is supplied from a drive source included in the image forming apparatus. A rotary shaft of each of the rotary bodies of the developing device is extended outwardly from the interior of the casing of the developing device through the lateral wall of the casing in the axial direction, and the drive input gear that supplies the torque to the rotary bodies is fixed to the rotary shaft outside the lateral wall. The torque is transmitted, either directly or via other gears, from the drive input gear to drive gears respectively provided to the rotary bodies so that the rotary bodies are rotated.

In recent years, the size of the casing of the developing device has been reduced to provide a more compact developing device. However, if the drive input gear protrudes outwardly beyond the casing of the developing device in a direction perpendicular to the axial direction, the advantage of the reduction in the size of the developing device is lost.

It is conceivable that one of the drive gears of the rotary bodies is used as the drive input gear in order to prevent the drive input gear from protruding outwardly beyond the casing of the developing device. However, because the rotary bodies are rotated together with the rotary shafts thereof and the drive gears, and the rotary shafts are rotated relative to the casing of the developing device, there is some play in the rotary shafts, thereby causing displacement of the rotary shafts relative to the casing. In general, because the drive input gear transmits torque to all the rotary bodies provided to the developing device, it tends to generate a large amount of torque. Thus, displacement of the axial center of a rotary shaft of the drive input gear may cause unstable rotation of the drive input gear. For these reasons, the rotary shaft of the drive input gear needs to be fixed to the lateral wall of the casing of the developing device, and therefore one of the drive gears cannot be used as the drive input gear.

Positions of each of the rotary bodies such as the developing roller and the conveyance screw are determined such that the rotary bodies function properly in the developing device, and the casing of the developing device is formed to accommodate the rotary bodies. A stationary shaft member, that is, the rotary shaft of the drive input gear that supports the drive input gear, is provided at a position other than the positions of the rotary shafts of the rotary bodies, and the drive input gear having a diameter larger than a diameter of the stationary shaft member is fixed to the stationary shaft member. As a result, the drive input gear tends to protrude beyond the casing of the developing device in the direction perpendicular to the axial direction.

The above-described problem occurs not only in the case in which the stationary shaft member fixed to the lateral wall of the casing of the developing device is used as the rotary shaft of the drive input gear but also in a case in which a stationary shaft member fixed to the lateral wall of the casing of the developing device outside the casing in the axial direction to rotatably support the drive input gear is disposed at a position different from the rotary shafts of the rotary bodies.

BRIEF SUMMARY OF THE INVENTION

In view of the foregoing, illustrative embodiments of the present invention provide a novel developing device that securely rotates a drive input gear disposed outside a lateral wall of a casing of the developing device in an axial direction and prevents the drive input gear from protruding outwardly beyond the casing of the developing device in a direction perpendicular to the axial direction. Illustrative embodiments of the present invention further provide an image forming apparatus including the developing device, and a process cartridge removably installable in the image forming apparatus.

In one illustrative embodiment, a developing device includes a developer bearing member rotatable while bearing developer on a surface thereof, a rotary body having a rotary shaft, a casing that contains the developer supplied to the surface of the developer bearing member to accommodate at least a portion of the rotary body, a rotary gear having a rotary shaft parallel to the rotary shaft of the rotary body and disposed outside a lateral wall of the casing to support an end of the rotary shaft of the rotary body, and a stationary shaft member fixed to the lateral wall of the casing to rotatably support the rotary gear. An axial center of the stationary shaft member is collinear with an axial center of the rotary shaft of the rotary body.

In another illustrative embodiment, an image forming apparatus includes a latent image bearing member, a charger to charge a surface of the latent image bearing member, a latent image forming unit to form a latent image on the surface of the latent image bearing member, and the developing device described above.

In yet another illustrative embodiment, a process cartridge removably installable in an image forming apparatus includes a latent image bearing member to bear a latent image and the developing device described above. The latent image bearing member and the developing device constitute a single integrated unit removably installable in the image forming apparatus.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
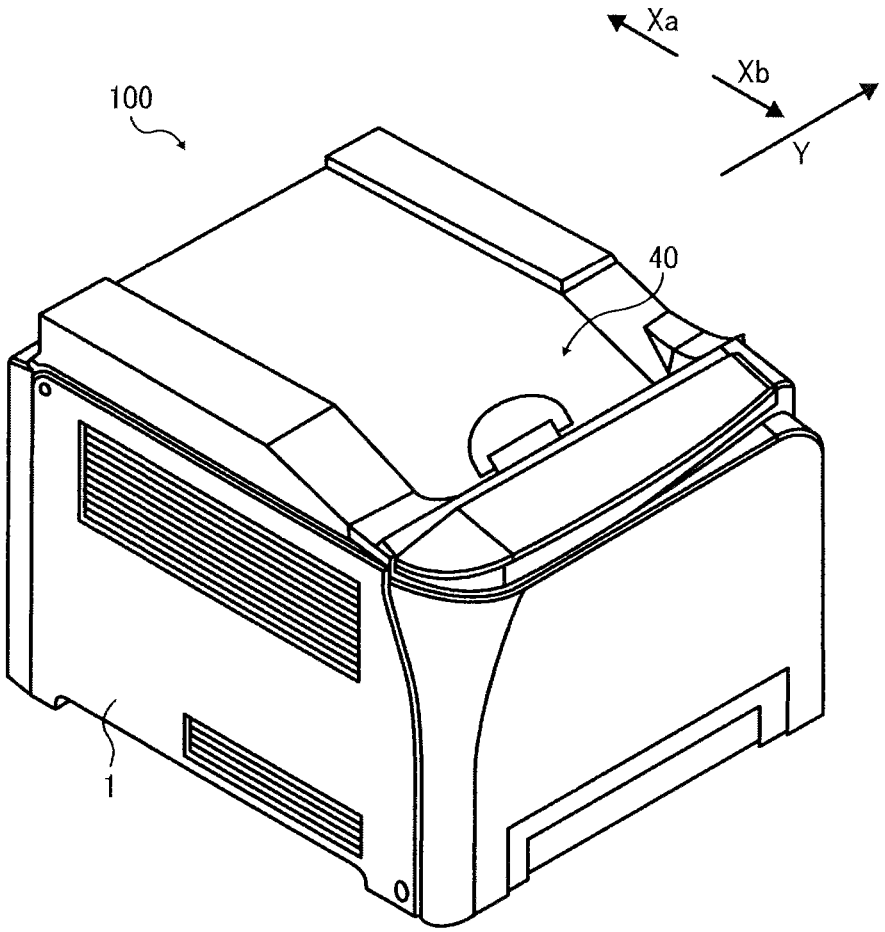
FIG. 1 is a perspective view illustrating the external appearance of an example of an image forming apparatus according to an illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Hereinafter, a "sheet" of recording media is not limited to a sheet of paper (e.g., cardboards, postcards, envelopes, plain paper, and thin paper), but also includes any material onto which images may be transferred, including but not limited to coated paper, art paper, OHP sheets or OHP film, and tracing paper.

Figure 2:
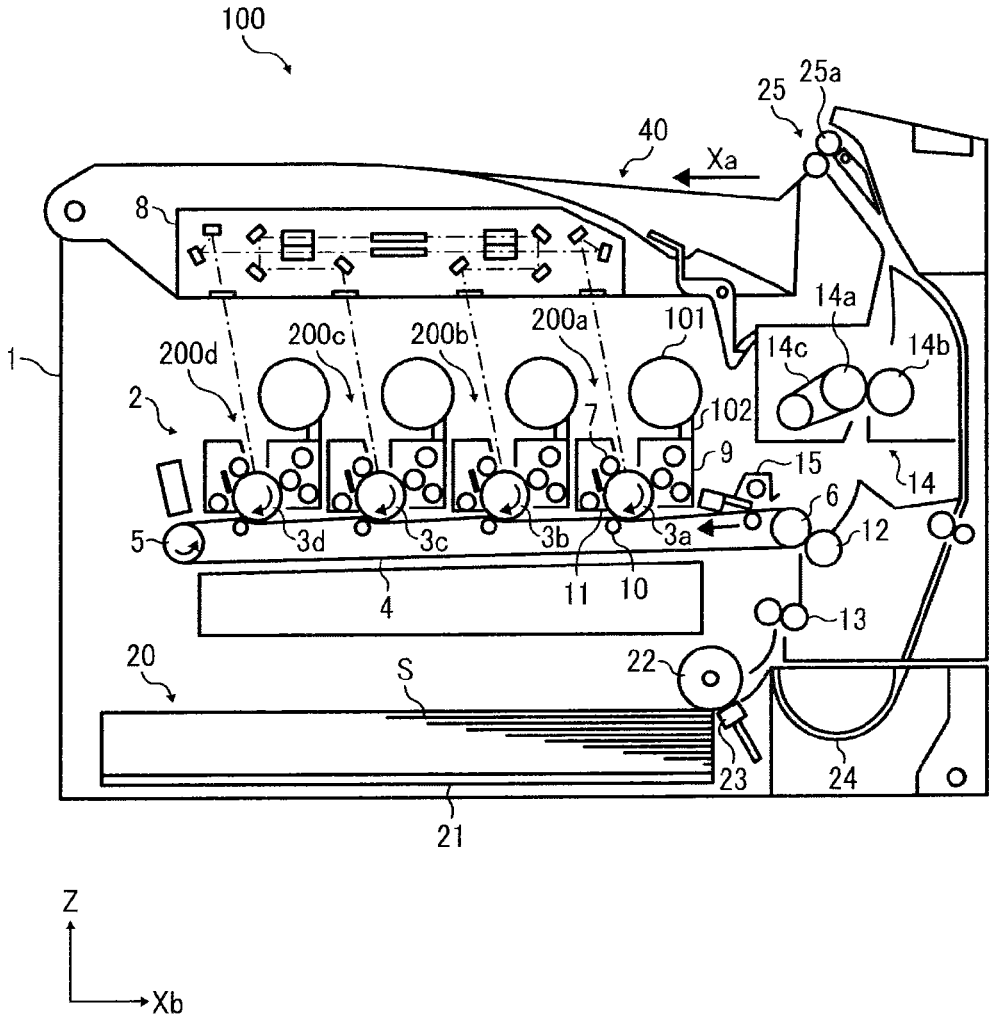
FIG. 2 is a vertical cross-sectional view illustrating an example of a configuration of the image forming apparatus illustrated in FIG. 1.

A description is now given of a configuration and operation of an image forming apparatus 100 according to an illustrative embodiment with reference FIGS. 1 and 2. FIG. 1 is a perspective view illustrating the external appearance of an example of the image forming apparatus 100. FIG. 2 is a vertical cross-sectional view illustrating an example of a configuration of the image forming apparatus 100. It is to be noted that in the present illustrative embodiment, the image forming apparatus 100 is a tandem-type full-color printer.

The image forming apparatus 100 includes an image forming unit 2 that forms an image on a recording medium such as a sheet of paper. The image forming unit 2 is disposed substantially at the center of a main body 1 of the image forming apparatus 100 and includes image forming members described in detail later. The image forming apparatus 100 further includes a sheet feeder 20 disposed below the image forming unit 2 to feed a sheet S to the image forming unit 2. After an image is formed on the sheet S by the image forming unit 2, the sheet S is discharged from the main body 1 by a sheet discharger 25 disposed above the image forming unit 2. The sheet discharger 25 discharges the sheet S having the image thereon from the front (the lower right in FIG. 1) to the rear (the upper left in FIG. 1) of the image forming apparatus 100 as indicated by arrow Xa in FIG. 1 of 2 (hereinafter referred to as a sheet discharging direction Xa). The sheet S thus discharged by the sheet discharger 25 is then stacked on a stacking unit 40 disposed above the image forming unit 2.

It is to be noted that in FIG. 1 and so on, arrow Y indicates a width direction of the sheet S perpendicular to the sheet discharging direction Xa, arrow Xb indicates a direction opposite the sheet discharging direction Xa, and arrow Z indicates a vertical direction.

The image forming unit 2 includes multiple latent image bearing members, which, in the present illustrative embodiment, are drum-type photoconductors 3*a*, 3*b*, 3*c*, and 3*d* (hereinafter collectively referred to as photoconductors 3), on each of which a toner image of a different color is formed. In the image forming apparatus 100, toner images of yellow, cyan, magenta, and black are formed on the photoconductors 3, respectively. The photoconductors 3 are arranged side by side in parallel to one another at predetermined intervals, and an intermediate transfer member, which, in the present illustrative embodiment, is a seamless intermediate transfer belt 4, is disposed below and opposite the photoconductors 3. The intermediate transfer belt 4 is wound around a first support roller 5 and a second support roller 6 to be rotated in a counterclockwise direction in FIG. 2. Alternatively, a drum-type image bearing member may be used as the intermediate transfer member.

Each of the photoconductors 3 has the same basic configuration, differing only in the color of toner used. Therefore, the rightmost photoconductor 3*a* on which a yellow toner image is formed is taken as a representative example to describe a configuration around each of the photoconductors 3, and only reference numerals denoting those components disposed around the photoconductor 3*a* are shown in FIG. 2.

A charger 7 that evenly charges a surface of the photoconductor 3*a* is provided around the photoconductor 3*a*. An exposure position at which a surface of the photoconductor 3*a* is exposed to a laser light emitted from a latent image forming unit, which, in the present illustrative embodiment, is an optical scanner (LSU: laser scanner unit) 8, based on image data to form an electrostatic latent image on the surface of the photoconductor 3*a* is provided downstream from the charger 7 in a direction of rotation of the photoconductor 3*a*. A developing device 9 that develops the electrostatic latent image formed on the surface of the photoconductor 3*a* with toner to form a toner image is provided downstream from the exposure position. Further, a primary transfer unit 10 provided opposite the photoconductor 3*a* with the intermediate transfer belt 4 interposed therebetween is disposed downstream from the developing device 9, and a cleaning device 11 that collects residual toner and so forth remaining on the surface of the photoconductor 3*a* after primary transfer of the toner image from the surface of the photoconductor 3*a* onto the intermediate transfer belt 4 is provided downstream from the primary transfer unit 10.

A cylindrical toner container 101 and a supply mechanism 102 are disposed above the developing device 9. The supply mechanism 102 is driven depending on an amount of toner consumed by the developing device 9 so that toner is supplied from the toner container 101 to the developing device 9. The toner container 101 is removably installable in the main body 1 of the image forming apparatus 100.

The image forming apparatus 100 further includes a secondary transfer roller 12 disposed opposite the second support roller 6 with the intermediate transfer belt 4 interposed therebetween.

When the image forming apparatus 100 starts image formation, the photoconductor 3*a* is rotated in a clockwise direction in FIG. 2, and at this time the surface of the photoconductor 3*a* is evenly charged to a predetermined polarity by the charger 7. Next, laser light emitted from the optical scanner 8 based on image data is directed onto the charged surface of the photoconductor 3*a* at the exposure position so that an electrostatic latent image of yellow is formed on the surface of the photoconductor 3*a*. The electrostatic latent image thus formed is then developed with yellow toner by the developing device 9. Accordingly, a yellow toner image is formed on the surface of the photoconductor 3*a*. Thereafter, the yellow toner image is primarily transferred onto the intermediate transfer belt 4 by the primary transfer unit 10.

During full-color image formation, the above-described image formation steps are performed on the rest of the photoconductors 3*b*, 3*c*, and 3*d*, respectively, so that toner images of yellow, cyan, magenta, and black respectively formed on the photoconductors 3 are sequentially transferred onto the intermediate transfer belt 4 one atop the other to form a single full-color toner image on the intermediate transfer belt 4.

In the sheet feeder 20 disposed below the image forming unit 2, a sheet feed tray 21 that accommodates the sheet S is provided. The sheet feeder 20 further includes a sheet feed roller 22 that feeds the sheet S from the sheet feed tray 21 and a separation unit, which, in the present illustrative embodiment, is a friction pad 23, that separates multiple sheet S fed from the sheet feed tray 21 one by one. A duplex conveyance path 24 through which the sheet S passes during duplex image formation is provided to the right of the sheet feeder 20 in FIG. 2.

The sheet S fed from the sheet feeder 20 is conveyed to a pair of registration rollers 13 so that a leading edge of the sheet S temporarily contacts the pair of registration rollers 13 which remains stationary. Accordingly, any skew of the sheet S is corrected. Then, the pair of registration rollers 13 is rotated at a predetermined timing to convey the sheet S to a secondary transfer position between the intermediate transfer belt 4 and the secondary transfer roller 12 in synchronization with the full-color toner image formed on the intermediate transfer belt 4. As a result, the full-color toner image is secondarily transferred onto the sheet S from the intermediate transfer belt 4 at the secondary transfer position.

The sheet S having the full-color toner image thereon is then conveyed to a fixing device 14. In the fixing device 14, heat and pressure are supplied to the sheet S to fix the full-color toner image on the sheet S. The sheet S having the fixed full-color image thereon is then discharged from the image forming apparatus 100 by a pair of discharge rollers 25*a* of the sheet discharger 25 to be stacked on the stacking unit 40 with a side having the image thereon facing down. The stacking unit 40 is provided on an upper surface of the main body 1 of the image forming apparatus 100. The fixing device 14 includes a fixing roller 14*a*, a fixing belt 14*c* wound around the fixing roller 14*a*, and a pressing roller 14*b* pressed against the fixing roller 14*a* with the fixing belt 14*c* interposed therebetween. A configuration of the fixing device 14 is not limited the above-describe example. Alternatively, a heater may be installed in the roller or an induction heater (IH) may be used as a heating system.

After secondary transfer of the toner image from the intermediate transfer belt 4 onto the sheet S, residual toner and so forth adhering to the intermediate transfer belt 4 is removed by a belt cleaning unit 15 so that the intermediate transfer belt 4 is ready for the next sequence of image formation.

Figure 3:
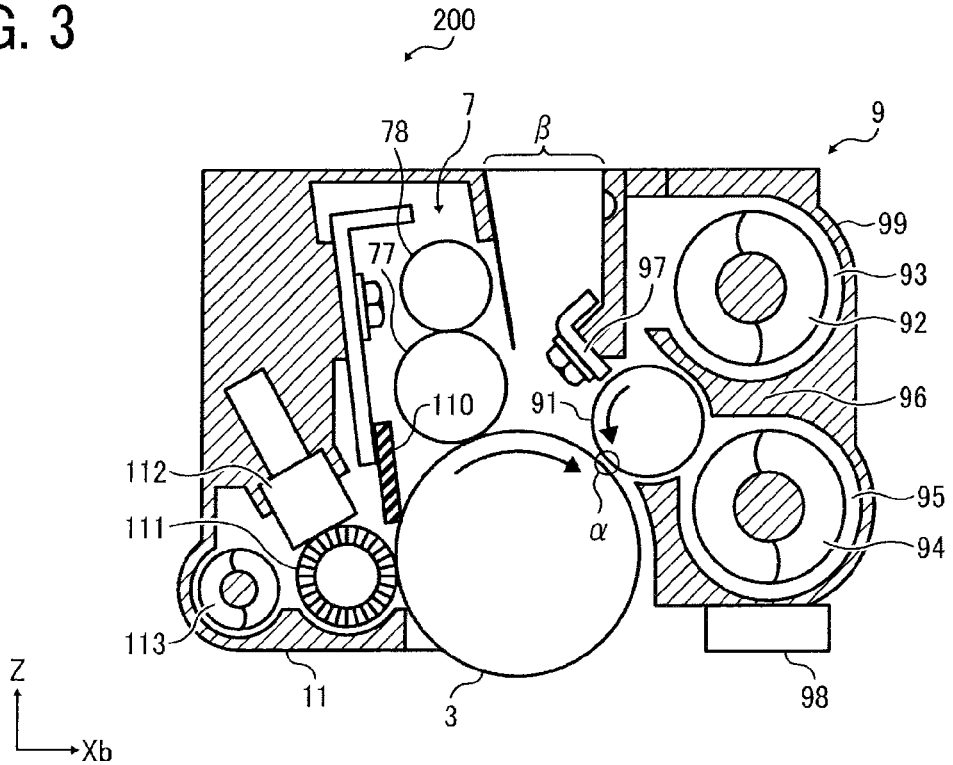
FIG. 3 is a vertical cross-sectional view illustrating an example of a configuration of a process cartridge removably installable in the image forming apparatus.

Each of the photoconductors 3 and their associated components constitute a single integrated process cartridge 200*a*, 200*b*, 200*c*, or 200*d* (hereinafter referred to as process cartridge 200), which is held by the same supporter and removably installable in the main body 1 of the image forming apparatus 100. FIG. 3 is a vertical cross-sectional view illustrating an example of a configuration of the process cartridge 200. The process cartridge 200 integrally holds the photoconductor 3, the developing device 9, the cleaning device 11, the charger 7, and so forth.

The cleaning device 11 includes a cleaning blade 110 that removes toner and so forth from the surface of the photoconductor 3 and a lubricant application brush 111 that scrapes off a solid lubricant 112 and supplies the lubricant 112 to the surface of the photoconductor 3. The cleaning device 11 further includes a collection screw 113 that conveys the toner and so forth removed from the surface of the photoconductor 3 by the cleaning blade 110 to a waste toner container, not shown.

The charger 7 includes a charging roller 77 to which a charging bias is supplied from a power source, not shown, to evenly charge the surface of the photoconductor 3 and a cleaning member 78 that removes foreign substances from a surface of the charging roller 77. An optical path β through which the laser light emitted from the optical scanner 8 passes is formed between the charger 7 and the developing device 9.

Figure 4:
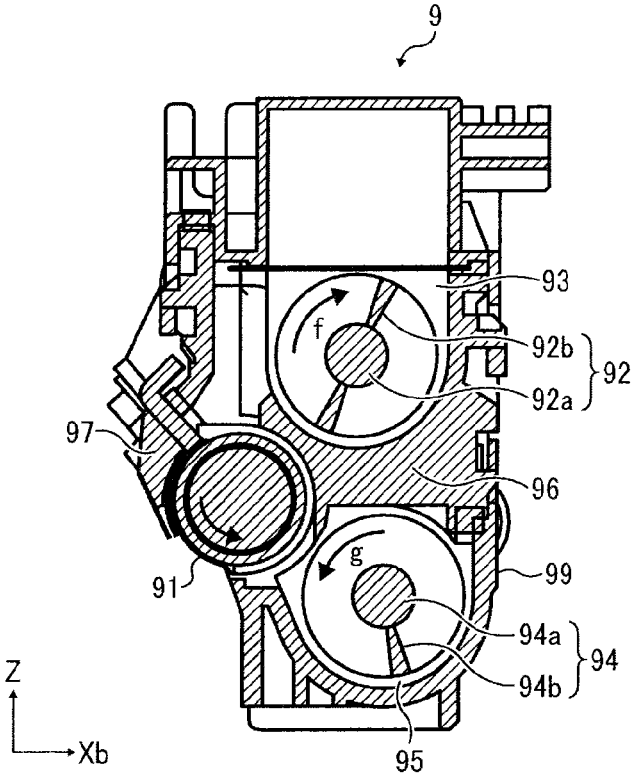
FIG. 4 is a vertical cross-sectional view illustrating an example of a configuration of a developing device included in the image forming apparatus.
Figure 5:
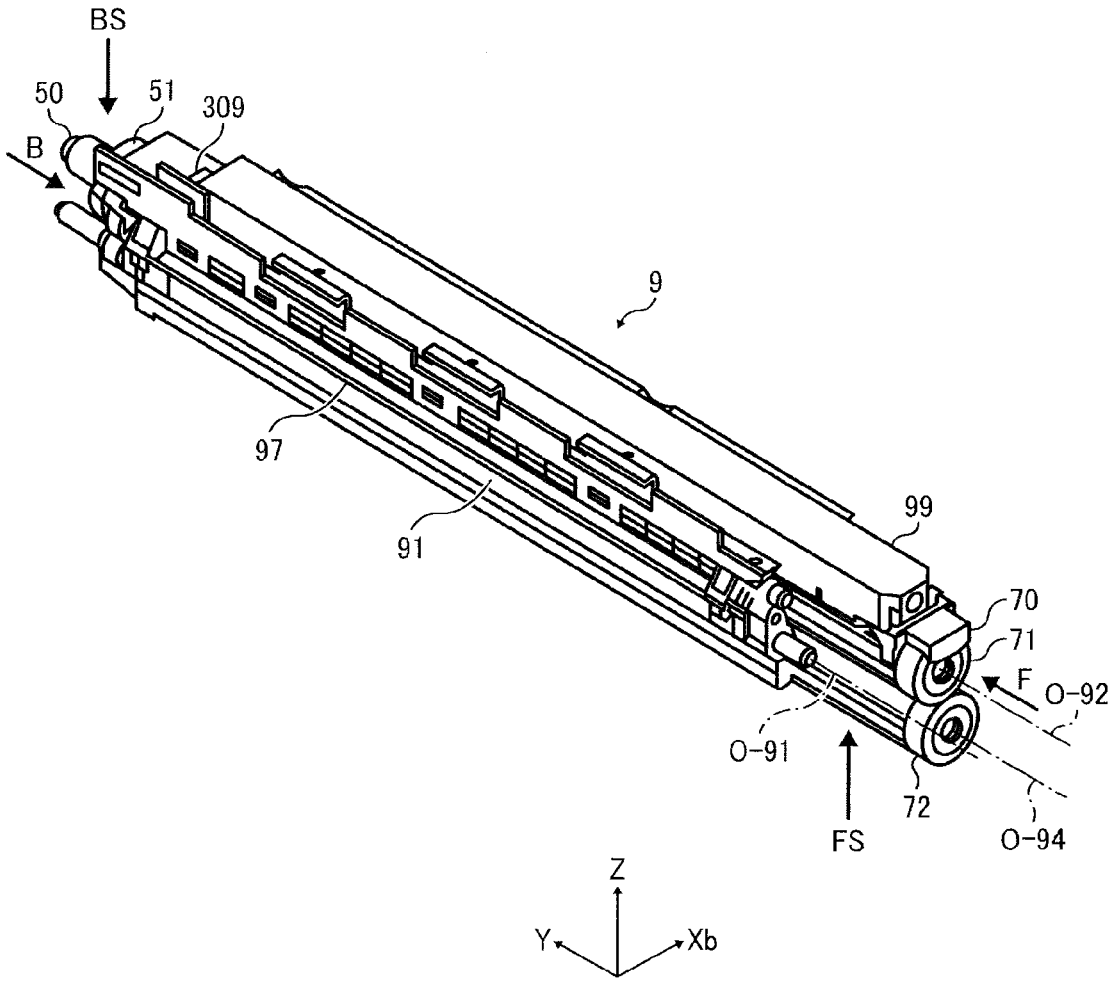
FIG. 5 is a perspective view illustrating the configuration of the developing device.
Figure 6:
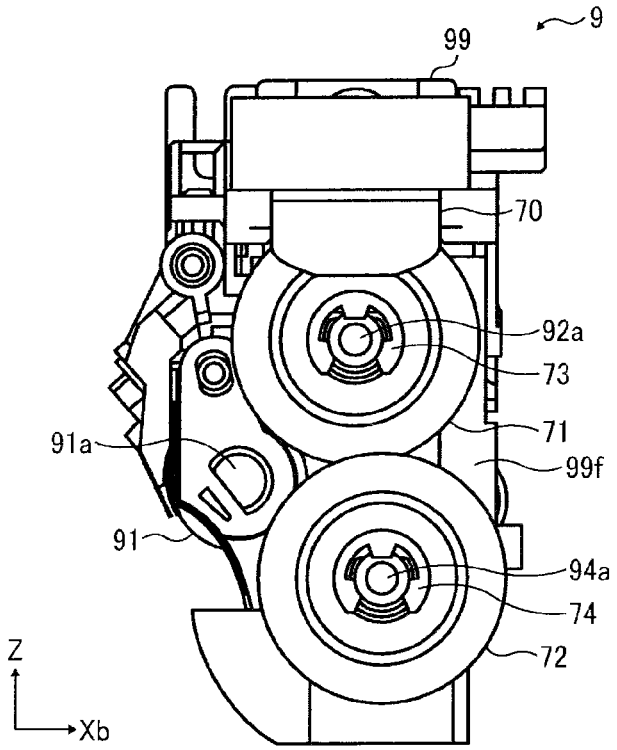
FIG. 6 is a front view illustrating the configuration of the developing device.
Figure 7:
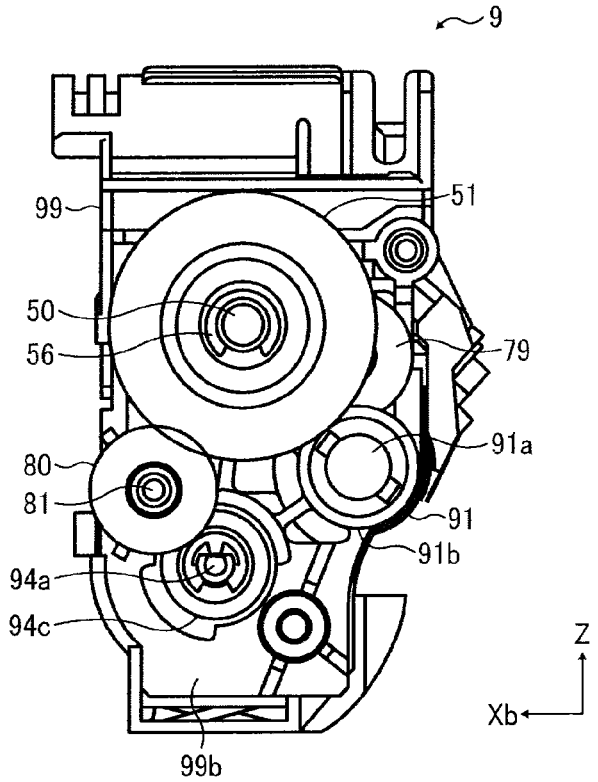
FIG. 7 is a rear view illustrating the configuration of the developing device.
Figure 8:
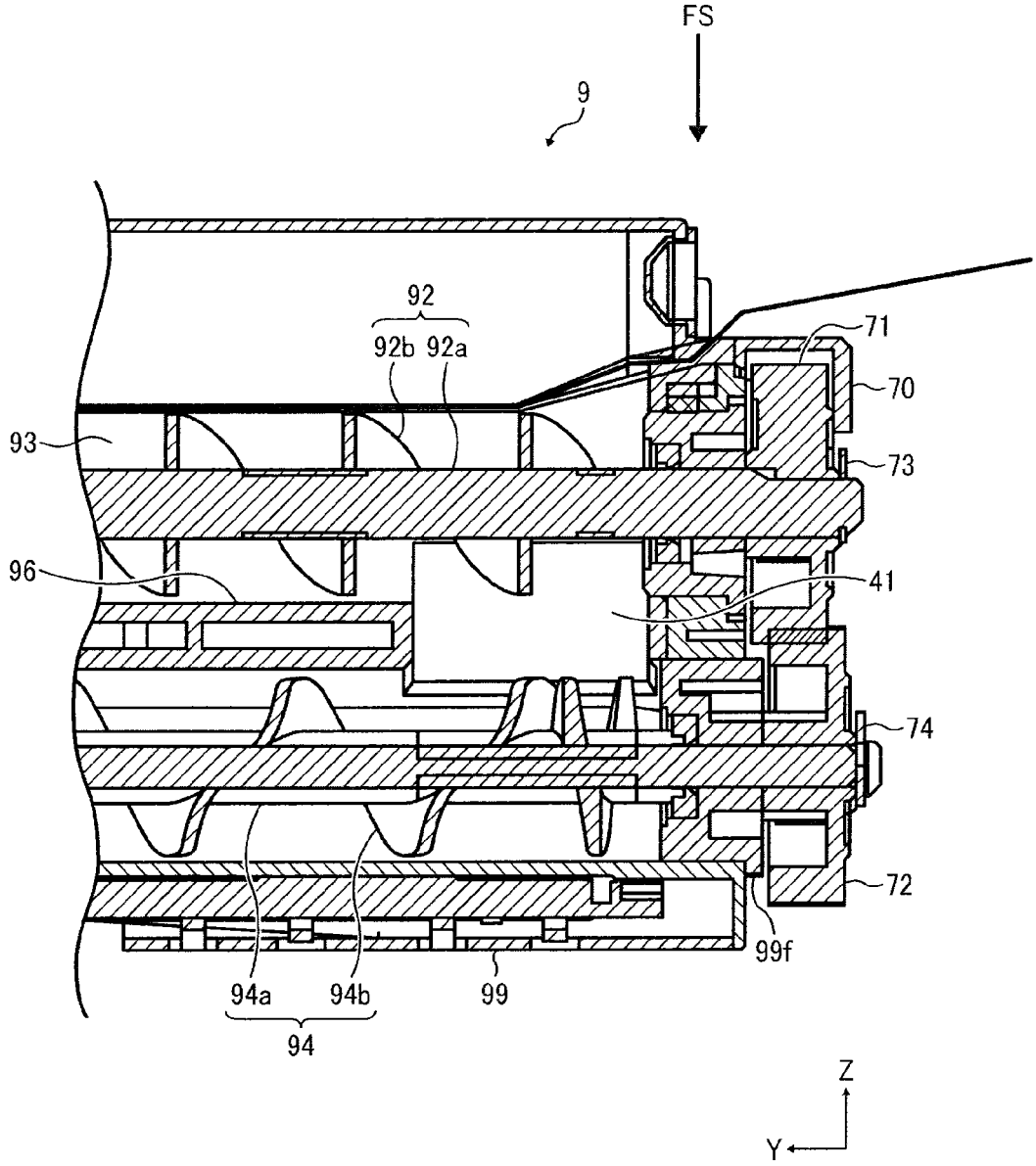
FIG. 8 is a vertical cross-sectional view illustrating an example of a configuration of a front end of the developing device.
Figure 9:
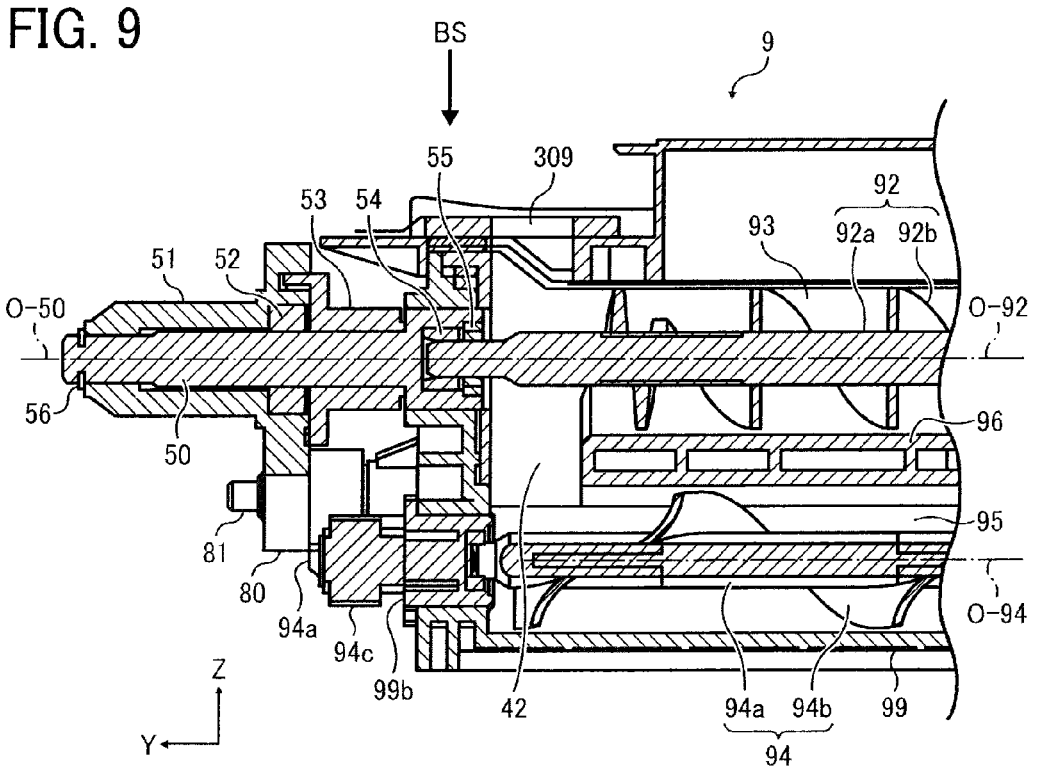
FIG. 9 is a vertical cross-sectional view illustrating an example of a configuration of a rear end of the developing device.

A description is now given of a detailed configuration of the developing device 9, with reference to FIGS. 4 to 9. FIG. 4 is a vertical cross-sectional view illustrating an example of a configuration of the developing device 9. FIG. 5 is a perspective view illustrating the configuration of the developing device 9. FIG. 6 is a front view illustrating the configuration of the developing device 9 viewed from arrow F in FIG. 5. FIG. 7 is a rear view illustrating the configuration of the developing device 9 viewed from arrow B in FIG. 5. FIG. 8 is a vertical cross-sectional view illustrating a configuration of a front end of the developing device 9 in an axial direction. FIG. 9 is a vertical cross-sectional view illustrating a configuration of a rear end of the developing device 9 in the axial direction.

The developing device 9 includes a developer bearing member, which, in the present illustrative embodiment, is a developing roller 91. The developing roller 91 is rotated while bearing developer thereon to supply the developer to the electrostatic latent image formed on the surface of the photoconductor 3 over a developing range a, shown in FIG. 3, where the developing roller 91 faces the photoconductor 3. The developing device 9 further includes a supply path 93 in which the developer is conveyed along the axial direction of the developing roller 91 while being supplied to the developing roller 91 and a supply screw 92 that supplies a conveyance force to the developer within the supply path 93. A circulation path, which, in the present illustrative embodiment, is a collection path 95 that conveys the developer reaching a downstream end of the supply path 93 to an upstream end thereof in a direction of conveyance of the developer, is disposed below the supply path 93. The developing device 9 further includes a collection screw 94 that supplies a conveyance force to the developer within the collection path 95.

Specifically, the supply path 93 is disposed diagonally above the developing roller 91 and the collection path 95 is disposed diagonally below the developing roller 91. Therefore, an installation space of the developing device 9 in a cross-section perpendicular to the rotary shaft of the developing roller 91 can be reduced. As a result, the process cartridge 200 including the developing device 9 can be downsized, thereby reducing the overall size of the image forming apparatus 100. In particular, because the image forming apparatus 100 includes the four developing devices 9 to form full-color images, reduction in the installation space of each of the developing devices 9 considerably downsizes the image forming apparatus 100.

The supply screw 92 is composed of a supply rotary shaft 92*a* and a spiral supply blade member 92*b* provided around the supply rotary shaft 92*a*. The supply screw 92 is rotated in a clockwise direction as indicated by arrow fin FIG. 4 around a center line O-92 of the supply screw 92 parallel to a center line O-91 of the developing roller 91. Rotation of the supply screw 92 conveys the developer from a front side FS to a rear side BS of the developing device 9 in a longitudinal direction thereof along the center line O-92 of the supply screw 92 while agitating the developer. Specifically, torque is supplied to the supply rotary shaft 92*a* of the supply screw 92 so that the supply screw 92 conveys the developer from the front side FS to the rear side BS of the developing device 9 in the axial direction of the supply screw 92.

The collection screw 94 is composed of a collection rotary shaft 94*a* and a spiral collection blade member 94*b* provided around the collection rotary shaft 94*a*. The collection screw 94 is rotated in a counterclockwise direction as indicated by arrow g in FIG. 4 around a center line O-94 of the collection screw 94 parallel to the center line O-91 of the developing roller 91. Rotation of the collection screw 94 conveys the developer from the rear side BS to the front side FS of the developing device 9 in the longitudinal direction along the center line O-94 of the collection screw 94 while agitating the developer. Specifically, torque is supplied to the collection rotary shaft 94*a* of the collection screw 94 so that the collection screw 94 conveys the developer from the rear side BS to the front side FS of the developing device 9, which is opposite the direction of conveyance of the developer conveyed by the supply screw 92.

The supply path 93 and the collection path 95 disposed below the supply path 93 are separated from each other by a partition wall 96 in the developing device 9 and only communicate with each other at an ascent opening 41 and a descent opening 42, both of which are provided at opposite ends of the partition wall 96 in the axial direction, respectively.

In the developing device 9, the developer in the supply path 93 disposed above the collection path 95 is supplied to the developing roller 91 by rotation of the supply screw 92. The developer thus supplied to the developing roller 91 is borne on the surface of the developing roller 91 and conveyed by rotation of the developing roller 91 in a counterclockwise direction in FIG. 4. An amount of developer borne on the surface of the developing roller 91 is restricted by a developer restriction member, which, in the present illustrative embodiment, is a doctor blade 97, at a doctor gap formed between the doctor blade 97 and the developing roller 91. Thus, developer having a thickness corresponding to the doctor gap is conveyed to the developing range α and toner is supplied to the electrostatic latent image formed on the surface of the photoconductor 3 so that the toner image is formed on the photoconductor 3.

The developer on the developing roller 91, after passing through the developing range α, is collected to the collection path 95 so that rotation of the collection screw 94 conveys the developer in the collection path 95 in the direction opposite the direction of conveyance of the developer in the supply path 93. The descent opening 42 that communicates with an upstream end of the collection path 95 is provided to the downstream end of the supply path 93. Developer that is not supplied to the developing roller 91 and thus conveyed to the downstream end of the supply path 93 is further conveyed to the collection path 95 through the descent opening 42.

A toner supply opening 309 from which toner is supplied from the toner container 101 by the supply mechanism 102 disposed above a casing 99 of the developing device 9 is provided above the downstream end of the supply path 93. The supply mechanism 102 supplies toner to the developing device 9 through the toner supply opening 309 based on an amount of toner consumed. The toner thus supplied through the toner supply opening 309 is conveyed to the collection path 95 via the descent opening 42 together with the developer that reaches the downstream end of the supply path 93.

The ascent opening 41 that communicates with the upstream end of the supply path 93 is provided to a downstream end of the collection path 95. The collection screw 94 provided within the collection path 95 conveys the developer in the axial direction so that the developer is accumulated near the downstream end of the collection path 95. The toner supplied through the toner supply opening 309 increases the toner density of the developer, and the developer accumulated at the downstream end of the collection path 95 is conveyed upward to the supply path 93 through the ascent opening 41. The developer conveyed back to the supply path 93 is then supplied to the developing roller 91 while being conveyed in the axial direction by rotation of the supply screw 92.

A toner density sensor 98 is disposed outwardly opposite the casing 99 of the developing device 9 near a portion where the developer is accumulated at the downstream end of the collection path 95. The toner density of the developer in the collection path 95 is magnetically detected by the toner density sensor 98.

A description is now given of a drive transmission unit of the developing device 9.

The drive transmission unit is composed of a rotary gear, which, in the present illustrative embodiment, is a drive input gear 51, an output gear 53, a first idler gear 79, a second idler gear 80, a developing roller drive gear 91*b*, a collection drive gear 94*c*, a collection output gear 72, a supply drive gear 71, and so forth. The drive input gear 51, the output gear 53, the first idler gear 79, the second idler gear 80, the developing roller drive gear 91*b*, and the collection drive gear 94*c* are disposed outside a rear wall 99*b* of the casing 99 of the developing device in the axial direction. The collection output gear 72 and the supply drive gear 71 are disposed outside a front wall 99*f* of the casing 99 in the axial direction.

As illustrated in FIG. 8, thrust movement of the supply drive gear 71 relative to the supply rotary shaft 92*a* is restricted by a supply E-ring 73, and thrust movement of the collection output gear 72 relative to the collection rotary shaft 94*a* is restricted by a collection E-ring 74. An upper portion of the casing 99 protrudes toward the front side FS of the developing device 9 and a leading edge of the protrusion is bent downward to form a thrust restriction member 70 for the supply screw 92. The thrust restriction member 70 contacts an end of the supply drive gear 71 on the front side FS in the axial direction to prevent the supply screw 92 to which the supply drive gear 71 is mounted from moving to the front side FS in the axial direction.

Each of the drive input gear 51 and the output gear 53 is fitted onto the rear wall 99*b* of the casing 99 and is rotatably supported by a stationary columnar shaft member, that is, a stud 50. The first idler gear 79 is rotatably supported by a stud member, not shown, fixed to the rear wall 99*b* of the casing 99. The second idler gear 80 is rotatably supported by a second idler stud 81 fixed to the rear wall 99*b* of the casing 99.

The developing roller drive gear 91*b* is fixed to a developing roller shaft 91*a* to be rotated together with the developing roller 91. Each of the collection drive gear 94*c* and the collection output gear 72 is fixed to the collection rotary shaft 94*a* to be rotated together with the collection screw 94. The supply drive gear 71 is fixed to the supply rotary shaft 92*a* to be rotated together with the supply screw 92.

A drive gear, not shown, is rotated by driving of a power source, that is, a drive motor provided to the main body 1 of the image forming apparatus 100. A reduced-diameter portion of the drive input gear 51 engages the drive gear so that torque of the drive gear is transmitted to the drive input gear 51. The output gear 53 is coupled to the drive input gear 51 by a coupling to be rotated together with the drive input gear 51.

The output gear 53 engages the first idler gear 79, and the first idler gear 79 further engages the developing roller drive gear 91*b* which is rotated together with the developing roller 91. Rotation of the drive input gear 51 transmits the torque to the developing roller drive gear 91*b* via the output gear 53 and the first idler gear 79 to rotate the developing roller 91. An enlarged-diameter portion of the second idler gear 80 engages the reduced-diameter portion of the drive input gear 51, and a reduced-diameter portion of the second idler gear 80 engages the collection drive gear 94*c*. Rotation of the drive input gear 51 transmits the torque to the collection drive gear 94*c* via the second idler gear 80 to rotate the collection screw 94. The collection output gear 72 engages the supply drive gear 71, and rotation of the collection screw 94 rotates the collection output gear 72, thereby transmitting the torque to the supply drive gear 71 to rotate the supply screw 92.

A further description is now given of features of the developing device 9 according to the present illustrative embodiment.

In the developing device 9, a center line O-50, which is the axial center of the stud 50, and the center line O-92, which is the axial center of the supply rotary shaft 92*a*, are collinear. The stud 50 is a columnar member protruding outwardly beyond the rear wall 99*b* of the casing 99 in the axial direction and rotatably supports the drive input gear 51 such that the drive input gear 51 is rotated around the center line O-50 of the stud 50. In addition, the stud 50 is a stationary shaft member fixed to the rear wall 99*b* of the casing 99 so that displacement of the stud 50 relative to the casing 99 can be prevented. Because the drive input gear 51 is rotatably supported by the stud 50 having the above-described configuration, displacement of the center of rotation of the drive input gear 51 relative to the casing 99 can be prevented, thereby securely transmitting the torque from the drive motor to the rotary bodies.

Figure 10:
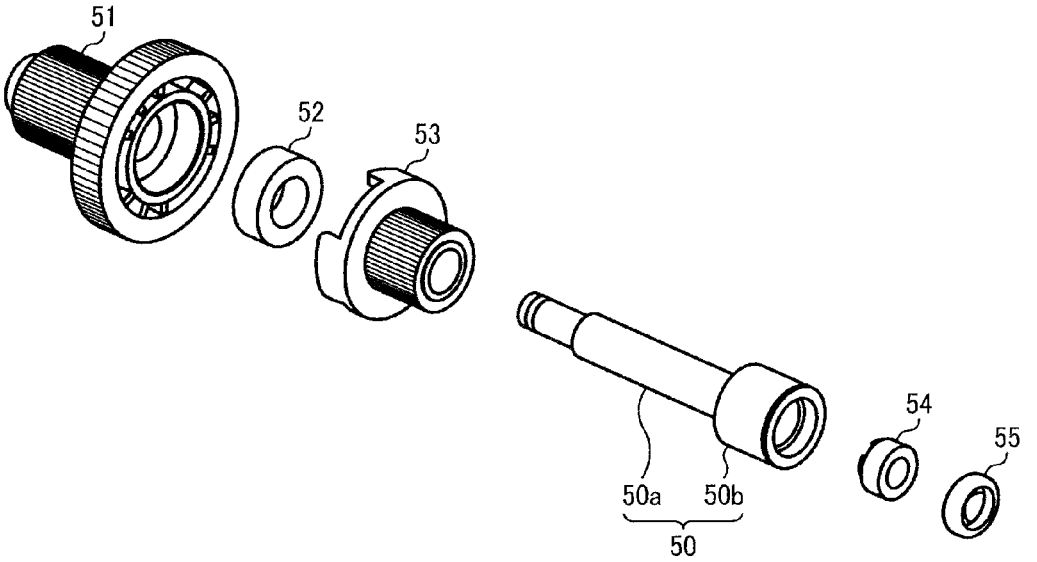
FIG. 10 is an exploded perspective view illustrating components mounted to a stud included in the developing device.

A detailed configuration in which the center lines O-50 and O-92 are collinear is described below. FIG. 10 is an exploded perspective view illustrating the components mounted to the stud 50.

The stud 50 is formed of metal such as SUS and SUM and has a reduced-diameter portion 50*a* and an enlarged-diameter portion 50*b*. An end of the stud 50 in which the enlarged-diameter portion 50*b* is formed has an inward-facing opening, and a rotary shaft supporter, which, in the present illustrative embodiment, is a resin bearing 54, and a G-seal 55 are provided inside the opening. The bearing 54 is fixed to the stud 50 by being fitted onto the stud 50.

The drive input gear 51, into which a ball bearing 52 is fitted and to which the output gear 53 is mounted, is attached to the reduced diameter portion 50*a* of the stud 50. The output gear 53 and the drive input gear 51 are coupled to each other by a coupling. An E-ring 56 (shown in FIG. 9) is fitted into a notch formed in a leading end of the reduced-diameter portion 50*a* so that thrust movement of each of the output gear 53 and the drive input gear 51 relative to the stud 50 is restricted.

In the developing device 9, an inboard end of the stud 50 disposed inside the casing 99 is not covered with the rear wall 99*b* but is exposed to the supply path 93, and therefore a seal member, which, in the present illustrative embodiment, is the G-seal 55, is provided to the inward-facing opening of the stud 50 to prevent toner leakage. In addition, the resin bearing 54 is provided between the G-seal 55 and the opening so that the bearing 54 rotatably supports the rear end of the supply rotary shaft 92*a* of the supply screw 92 in the axial direction. Thus, provision of the G-seal 55 prevents entry of the developer within the bearing 54. The bearing 54 that rotatably supports the supply rotary shaft 92*a* is provided within the stud 50 so that the center line O-50 of the stud 50 and the center line O-92 of the supply rotary shaft 92*a* are collinear.

Because the center lines O-50 and O-92 are collinear, both the stud 50 and the supply rotary shaft 92*a* are placed on the same position on a virtual plane perpendicular to the axial direction. The supply screw 92 has the supply blade member 92*b* having a diameter larger than a diameter of the supply rotary shaft 92*a*, and the casing 99 of the developing device 9 is formed to accommodate the supply screw 92. Thus, even when the drive input gear 51 having a diameter larger than a diameter of the stud 50 is provided to the stud 50, the drive input gear 51 does not protrude outwardly beyond the casing 99 in the direction perpendicular to the axial direction.

As described above, the stud 50, which is extended outside the rear wall 99*b* of the casing 99 in the axial direction and rotatably supports the drive input gear 51, is provided with the bearing 54 of the supply screw 92. Thus, the bearing 54 is provided within the stud 50 fixed to the rear wall 99*b* of the casing 99, thereby providing precise positioning of the components. In addition, the drive input gear 51 can be disposed within a limited space in the rear wall 99*b* of the casing 99 of the developing device 9 having a reduced installation space in a cross-section perpendicular to the axial direction.

If the drive input gear 51 is provided to a rotary body such as the supply screw 92, because the supply screw 92 is rotated relative to the casing 99, the supply screw 92 is provided to the casing 99 with slight play although being supported by the bearing, thereby causing displacement of the rotary shaft of the supply screw 92. Consequently, in a case in which the drive input gear 51 is supported by the shaft of the supply screw 92, irregular rotation of the drive input gear 51 may occur.

By contrast, in the developing device 9 according to the present illustrative embodiment, the stud 50 is fixed to the rear wall 99*b* of the casing 99 so that the shaft of the stud 50 does not displace relative to the casing 99. Therefore, provision of the drive input gear 51 to the stud 50 can achieve secure transmission of the torque.

It is conceivable that the stud 50 is formed of resin together with the rear wall 99*b* of the casing 99. However, in consideration of abrasion resistance and heat resistance requirements, a resin stud is less durable. Therefore, it is preferable that the stud 50 be formed of metal.

The stud 50 is fixed to the rear wall 99*b* of the casing 99 by being bonded to or fitted onto the rear wall 99*b*. An example of fixation of the stud 50 to the rear wall 99*b* of the casing 99 is described below.

First, the enlarged-diameter portion 50*b* of the stud 50 is fitted into the rear wall 99*b* of the casing 99 and ultrasound is used to melt the resin of the rear wall 99*b* so that the stud 50 is fixed to the rear wall 99*b* of the casing 99 when the melted part of the rear wall 99*b* is solidified. Thereafter, the bearing 54 and the G-seal 55 are fitted onto the stud 50.

If the bearing 54 and the G-seal 55 are attached to the stud 50 before the stud 50 is fixed to the rear wall 99*b* of the casing 99 and then ultrasound is applied to the rear wall 99*b*, high-frequency vibration of the supersonic wave displaces the bearing 54 within the stud 50. In addition, because the bearing 54 is formed of resin, the bearing 54 might melt and deform. By contrast, displacement and deformation of the bearing 54 can be prevented by fitting the bearing 54 and the G-seal 55 onto the stud 50 after the stud 50 is fixed to the rear wall 99*b* of the casing 99.

A description is now given of a first variation of the present illustrative embodiment.

According to the present illustrative embodiment described above, a right end of the stud 50 in FIG. 9 directly contacts the developer. The developer includes toner and carrier, and the toner used in the developing device 9 tends to adhere at the temperature higher than 45° C. During operation of the developing device 9, rotation of the drive input gear 51 rotatably supported by the stud 50 generates frictional heat. In addition, the stud 50 formed of metal has higher heat conductivity than the casing 99 formed of resin. Therefore, heat generated by friction at the reduced-diameter portion 50*a* of the stud 50 to which the drive input gear 51 is provided tends to be transmitted to the enlarged-diameter portion 50*b* of the stud 50.

Experiments confirmed that a temperature at the end of the enlarged-diameter portion 50*b* of the stud 50 in the axial direction gradually increases and ultimately reaches 46° C. during continuous operation of the developing device 9. Thus, when the temperature of the end of the enlarged-diameter portion 50*b* of the stud 50 in the axial direction exceeds the temperature in which the toner tends to adhere, adherence of toner may occur at a portion where the stud 50 contacts the developer.

Figure 11A:
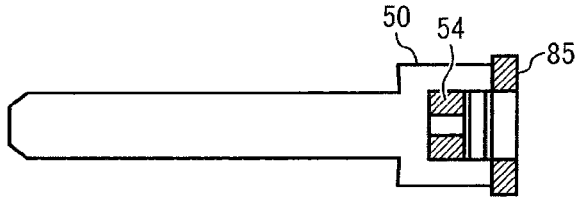
FIGS. 11A and 11B are schematic views respectively illustrating an example of a configuration of a stud according to a first variation.
Figure 11B:
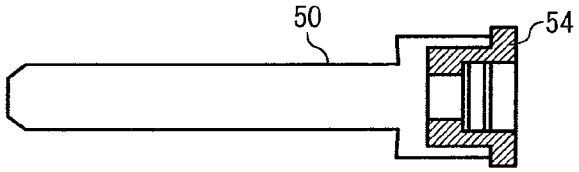

FIGS. 11A and 11B are schematic views respectively illustrating an example of a configuration of the stud 50 according to the first variation. Specifically, the configuration illustrated in FIG. 11A includes a prevention member, which, in the present illustrative embodiment, is a cover member 85 that covers a portion of the stud 50 exposed to the developer. In the configuration illustrated in FIG. 11B, the bearing 54 is shaped such that the portion of the stud 50 exposed to the developer is covered with the bearing 54.

In FIG. 11A, the cover member 85 formed of resin or polyurethane form is provided to the right end of the stud 50. As a result, the developer within the supply path 93 is prevented from directly contacting the metal stud 50.

When the configuration illustrated in FIG. 11A was employed to the developing device 9, it was confirmed that the temperature of the cover member 85 during continuous operation of the developing device 9 was 43° C., thereby preventing adherence of toner.

In FIG. 11B, the bearing 54 is shaped to cover the portion of the stud 50 exposed to the supply path 93. Accordingly, the number of components can be reduced compared to the configuration illustrated in FIG. 11A in which the cover member 85 is provided.

When the configuration illustrated in FIG. 11B was employed to the developing device 9, it was confirmed that the temperature of a portion of the bearing 54 that covers the stud 50 during continuous operation of the developing device 9 was 43° C., thereby preventing adherence of toner.

Because the stud 50 is formed of metal, the temperature of the stud 50 tends to increase due to friction generated during rotation of the drive input gear 51 attached to the stud 50 and rotation of the supply screw 92. An increase in the temperature of the stud 50 may melt toner included in the developer that contacts the stud 50, thereby causing adherence of toner to the stud 50. The adherence of toner to the stud 50 may prevent rotation of the supply screw 92 or may clog the doctor gap, thereby preventing supply of the developer to the developing roller 91 over the developing range $\alpha$. Consequently, white spots may appear in the resultant image, thereby degrading image quality.

By contrast, in the configurations according to the first variation illustrated in FIGS. 11A and 11B, respectively, the developer is prevented from directly contacting the stud 50. As a result, adherence of the toner to the stud 50 can be prevented, thereby reliably rotating the supply screw 92 and providing higher-quality images.

In addition, in the configuration illustrated in FIG. 11B, the bearing 54 that supports the shaft of the supply screw 92 is provided to the stud 50 which requires high positioning accuracy. As a result, the supply screw 92 also can be precisely positioned, thereby securely conveying the developer and thus improving image quality. Further, the number of components can be reduced by covering the metal stud 50 with the resin bearing 54.

A description is now given of a second variation of the present illustrative embodiment.

According to the present illustrative embodiment described above, the rear end of the supply rotary shaft 92*a* in the rear side BS in the axial direction is disposed inside the stud 50 as illustrated in FIG. 9. Consequently, an E-ring, which is generally used for restricting thrust movement, cannot be provided to the rear end of the supply rotary shaft 92*a* to restrict thrust movement of the supply screw 92. As a result, during transportation or operation of the developing device 9, the supply rotary shaft 92*a* of the supply screw 92 may be detached from the bearing 54.

Figure 12A:
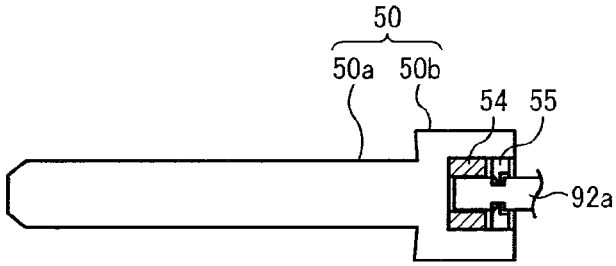
FIGS. 12A and 12B are schematic views respectively illustrating an example of a configuration of a stud according to a second variation.
Figure 12B:
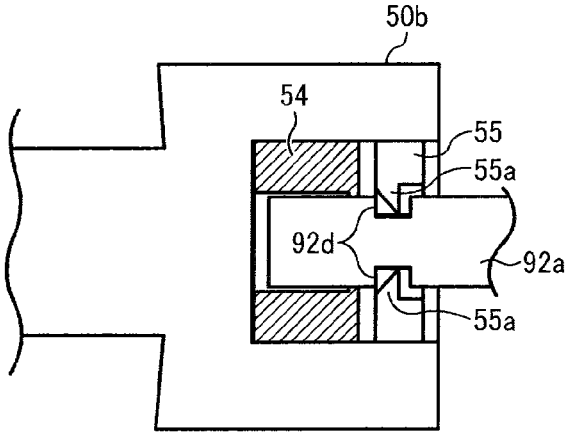

FIGS. 12A and 12B are schematic views respectively illustrating an example of a configuration of the stud 50 according to the second variation. Specifically, FIG. 12A is a schematic view illustrating an overall configuration of the stud 50 according to the second variation, and FIG. 12B is an enlarged schematic view illustrating the enlarged-diameter portion 50*b* of the stud 50 according to the second variation.

In the second variation, a lip 55*a* of the G-seal 55 fixed to the stud 50 enters a groove 92*d* formed in the supply rotary shaft 92*a*. Accordingly, the supply screw 92 does not separate from the bearing 54 during transportation or operation of the developing device 9, and is rotated at the proper position during operation. As a result, the developer is smoothly conveyed within the supply path 93, thereby achieving higher image quality.

In addition, the lip 55*a* of the G-seal 55 is disposed to contact the bottom of the groove 92*d* formed in the supply rotary shaft 92*a*. As a result, the G-seal 55 not only restricts the thrust movement of the supply screw 92 but also prevents entry of toner to the left of the G-seal 55 in FIGS. 12A and 12B, thereby preventing toner scattering.

In the foregoing illustrative embodiment and variations, the axial center of the rotary body, that is, the supply screw 92, and the axial center of the stationary shaft member, that is, the stud 50, are collinear. Alternatively, an axial center of a rotary body other than the supply screw 92 may be collinear with the axial center of the stationary shaft member. The axial center of either the collection screw 94 or the developing roller 91 may be collinear with the axial center of the stud 50 depending on the gear train disposed to the rear wall 99*b* of the casing 99. The relation between the stud 50 and the supply screw 92 according to the foregoing illustrative embodiment and variations is also applicable to the above-described case in which the axial center of either the collection screw 94 or the developing roller 91 is collinear with the axial center of the stud 50. In addition, in a developing device in which a rotary body other than the developing roller 91, the supply screw 92, and the collection screw 94 is included, an axial center of such a rotary body may be collinear with the axial center of the stud 50. In such a developing device, effects similar to those achieved by the foregoing illustrative embodiment can be achieved.

In the foregoing illustrative embodiment and variations, the two developer paths, that is, the supply path 93 and the collection path 95, are disposed one above the other in the developing device 9 so that the developer is circulated in the single direction. However, the above-described configuration in which the axial center of the rotary body is collinear with the axial center of the stationary shaft member is also applicable to a developing device in which both supply and collection of the developer is performed by the supply path. In addition, the foregoing illustrative embodiment and variations are applicable not only to the developing device using the two-component developer but also to a developing device using a single-component developer as long as the developing device includes the rotary body having the rotary shaft parallel to the axial direction.

Moreover, the stationary shaft member, the axial center of which is collinear with the axial center of the rotary body, is not limited to the stud 50 that supports the drive input gear 51. Alternatively, a shaft member fixed to the lateral wall of the casing at an end of the developing device 9 in the axial direction such as a shaft of an idler gear may be used as the stationary shaft member.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A developing device comprising:

a developer bearing member rotatable while bearing developer on a surface thereof;

a rotary body having a rotary shaft;

a casing that contains the developer supplied to the surface of the developer bearing member to accommodate at least a portion of the rotary body;

a rotary gear having a rotary shaft parallel to the rotary shaft of the rotary body, the rotary gear being disposed outside a lateral wall of the casing; and a stationary shaft member fixed to the lateral wall of the casing to rotatably support the rotary gear, wherein the stationary shaft member supports an end of the rotary shaft of the rotary body, and at least a portion of the stationary shaft member is positioned within the rotary gear to rotatably support the rotary gear, and wherein an axial center of the stationary shaft member being collinear with an axial center of the rotary shaft of the rotary body.

2. The developing device according to claim 1, wherein the rotary gear comprises a drive input gear to which torque is externally supplied to rotate at least the rotary body provided to the developing device.

3. The developing device according to claim 1, further comprising a rotary shaft supporter provided to an inboard end of the stationary shaft member to rotatably support the end of the rotary shaft of the rotary body, wherein the inboard end of the stationary shaft member is exposed to a space formed inboard of the lateral wall of the casing.

4. The developing device according to claim 3, further comprising a prevention member provided to the inboard end of the stationary shaft member to prevent the developer within the space formed inboard of the lateral wall of the casing from contacting the inboard end of the stationary shaft member.

5. The developing device according to claim 4, further comprising a bearing that rotatably supports the end of the rotary shaft of the rotary body, wherein the bearing is formed of a material having lower thermal conductivity than the stationary shaft member and is shaped to cover a part of the inboard end of the stationary shaft member exposed to the space formed inboard of the lateral wall of the casing.

6. The developing device according to claim 3, further comprising a seal member provided to the stationary shaft member to prevent the developer within the space formed inboard of the lateral wall of the casing from reaching the rotary shaft supporter, wherein the seal member restricts movement of the rotary shaft of the rotary body in an axial direction.

7. An image forming apparatus comprising:

a latent image bearing member;

a charger to charge a surface of the latent image bearing member;

a latent image forming unit to form a latent image on the surface of the latent image bearing member; and a developing device to develop the latent image with developer, the developing device comprising:

a developer bearing member rotatable while bearing the developer on a surface thereof;

a rotary body having a rotary shaft;

a casing that contains the developer supplied to the surface of the developer bearing member to accommodate at least a portion of the rotary body;

a rotary gear having a rotary shaft parallel to the rotary shaft of the rotary body, the rotary gear being disposed outside a lateral wall of the casing; and a stationary shaft member fixed to the lateral wall of the casing to rotatably support the rotary gear, wherein the stationary shaft member supports an end of the rotary shaft of the rotary body, and at least a portion of the stationary shaft member is positioned within the rotary gear to rotatably support the rotary gear, and wherein an axial center of the stationary shaft member being collinear with an axial center of the rotary shaft of the rotary body.

8. A process cartridge removably installable in an image forming apparatus, comprising:

a latent image bearing member to bear a latent image; and a developing device to develop the latent image formed on the latent image bearing member with developer, the developing device comprising:

a developer bearing member rotatable while bearing the developer on a surface thereof;

a rotary body having a rotary shaft;

a casing that contains the developer supplied to the surface of the developer bearing member to accommodate at least a portion of the rotary body;

a rotary gear having a rotary shaft parallel to the rotary shaft of the rotary body, the rotary gear being disposed outside a lateral wall of the casing; and a stationary shaft member fixed to the lateral wall of the casing to rotatably support the rotary gear, wherein the stationary shaft member supports an end of the rotary shaft of the rotary body, and at least a portion of the stationary shaft member is positioned within the rotary gear to rotatably support the rotary gear, and wherein an axial center of the stationary shaft member being collinear with an axial center of the rotary shaft of the rotary body, the latent image bearing member and the developing device constituting a single integrated unit removably installable in the image forming apparatus.

9. A developing device comprising:

a developer bearing member rotatable while bearing developer on a surface thereof;

a rotary body having a rotary shaft;

a casing that contains the developer supplied to the surface of the developer bearing member;

a rotary gear having a rotation axis parallel to the rotary shaft of the rotary body, the rotary gear being disposed outside a lateral wall of the casing; and a stationary shaft member fixed to the lateral wall of the casing to rotatably support the rotary gear, wherein the stationary shaft member supports an end of the rotary shaft of the rotary body, and at least a portion of the stationary shaft member is positioned within the rotary gear to rotatably support the rotary gear.

10. The developing device according to claim 9, further comprising a rotary shaft supporter provided to an inboard end of the stationary shaft member to rotatably support the end of the rotary shaft of the rotary body, wherein the inboard end of the stationary shaft member is exposed to a space formed inboard of the lateral wall of the casing.

11. The developing device according to claim 10, further comprising a prevention member provided to the inboard end of the stationary shaft member to prevent the developer within the space formed inboard of the lateral wall of the casing from contacting the inboard end of the stationary shaft member.

12. The developing device according to claim 11, further comprising a bearing that rotatably supports the end of the rotary shaft of the rotary body, wherein the bearing is formed of a material having lower thermal conductivity than the stationary shaft member and is shaped to cover a part of the inboard end of the stationary shaft member exposed to the space formed inboard of the lateral wall of the casing.

13. The developing device according to claim 10, further comprising a seal member provided to the stationary shaft member to prevent the developer within the space formed inboard of the lateral wall of the casing from reaching the rotary shaft supporter, wherein the seal member restricts movement of the rotary shaft of the rotary body in an axial direction.

14. The developing device according to claim 9, wherein an axial center of the stationary shaft member being collinear with an axial center of the rotary shaft of the rotary body.

* * * * *